US010680336B2

(12) United States Patent
Zhong et al.

(10) Patent No.: US 10,680,336 B2
(45) Date of Patent: Jun. 9, 2020

(54) ANTENNA DEVICE

(71) Applicant: Molex, LLC, Lisle, IL (US)

(72) Inventors: Guang-Yong Zhong, Shanghai (CN); Qiang Liu, Shanghai (CN)

(73) Assignee: Molex, LLC, Lisle, IL (US)

( * ) Notice: Subject to any disclaimer, the term of this patent is extended or adjusted under 35 U.S.C. 154(b) by 139 days.

(21) Appl. No.: 15/456,738

(22) Filed: Mar. 13, 2017

(65) Prior Publication Data

US 2017/0288311 A1 Oct. 5, 2017

(30) Foreign Application Priority Data

Mar. 31, 2016 (CN) ..... 2016 1 0199979

(51) Int. Cl.

| | |
|---|---|
| ***H01Q 1/24*** | (2006.01) |
| ***H01Q 5/30*** | (2015.01) |
| ***H01Q 9/04*** | (2006.01) |
| ***H01Q 13/10*** | (2006.01) |
| ***H01Q 5/371*** | (2015.01) |

(52) U.S. Cl.

CPC ..... *H01Q 9/0442* (2013.01); *H01Q 1/243* (2013.01); *H01Q 5/371* (2015.01); *H01Q 9/0421* (2013.01); *H01Q 13/10* (2013.01)

(58) Field of Classification Search

CPC ..... H01Q 1/24; H01Q 1/241; H01Q 1/242; H01Q 1/243; H01Q 1/38; H01Q 5/30; H01Q 5/307; H01Q 5/357; H01Q 5/364; H01Q 5/371; H01Q 5/50; H01Q 9/0421; H01Q 9/0442; H01Q 13/10

See application file for complete search history.

(56) References Cited

U.S. PATENT DOCUMENTS

| | | | | |
|---|---|---|---|---|
| 6,121,932 A * | 9/2000 | McCoy | ..... | H01Q 1/084 343/700 MS |
| 6,903,691 B2 * | 6/2005 | Sato | ..... | H01Q 1/243 343/700 MS |
| 8,138,987 B2 * | 3/2012 | Kapuliansky | ..... | H01Q 1/243 343/866 |
| 8,970,436 B2 * | 3/2015 | Yang | ..... | H01Q 1/243 343/700 MS |

(Continued)

FOREIGN PATENT DOCUMENTS

| | | |
|---|---|---|
| CN | 101582534 A | 11/2009 |
| CN | 102623801 A | 8/2012 |

(Continued)

*Primary Examiner* — Daniel Munoz
*Assistant Examiner* — Patrick R Holecek
(74) *Attorney, Agent, or Firm* — Molex, LLC

(57) ABSTRACT

An antenna device comprises a carrier, a first radiation portion, a second radiation portion and a coupling portion. The first radiation portion, the second radiation portion and the coupling portion are provided on the carrier. The second radiation portion electrically connects with the first radiation portion. The first radiation portion and the second radiation portion share a shared part, the shared part is directly connected to a reference grounding. The coupling portion capacitively couples an electrical signal to the first radiation portion and the second radiation portion. The first radiation portion and the second radiation portion convert the electrical signal into a radiation signal emitted by the antenna device.

23 Claims, 11 Drawing Sheets

(56) References Cited

U.S. PATENT DOCUMENTS

| | | | | |
|---|---|---|---|---|
| 9,300,041 | B2 | 3/2016 | Xu | |
| 2006/0017621 | A1* | 1/2006 | Okawara | H01Q 1/243 343/700 MS |
| 2015/0236417 | A1* | 8/2015 | Iellci | H01Q 5/328 343/850 |

FOREIGN PATENT DOCUMENTS

| | | | |
|---|---|---|---|
| CN | 102683829 | A | 9/2012 |
| CN | 103178325 | A | 6/2013 |
| CN | 103403962 | A | 11/2013 |
| CN | 103515699 | A | 1/2014 |
| CN | 104701609 | A | 6/2015 |
| JP | 11-004113 | A | 1/1999 |

* cited by examiner

Update axis lines info

ANTENNA DEVICE

RELATED APPLICATIONS

This application claims priority to Chinese Application No. 201610199979.9, filed Mar. 31, 2016, which is incorporated herein by reference in its entirety.

TECHNICAL FIELD

The present disclosure relates to an antenna device, and particularly relates to an antenna device having a slot.

BACKGROUND ART

Rapid development in communication field, particularly in consumer electronics field, makes requirement of a consumer on consumer electronics relavent products higher and higher, super-thin products emerge endlessly. As a key component of the consumer electronic products, miniaturization and multiple frequency bands of an antenna always lead designers of the antenna ceaselessly contemplations and improvements. How an antenna desired by the product can be designed under a limited space is one of subjects which are most popular at present. At present, multiple frequency band antennas have a deficiency on a given size, which cannot meet the requirement of the super-thin products. For example, a multiple frequency band ceramic antenna launched on the market uses three metal radiation portions to realize the desired frequency bands and uses a direct feed mode. However, as such, not only a size is limited, but also a bandwidth is very difficult to meet full frequency band required by the long term evolution (LTE). Therefore, it can be seen that designing a miniaturization multiple frequency band antenna definitely is a tendency in future.

In patent CN102623801, a direct feed design is used, which results in a deficiency that a communication frequency band is relative narrow. In order to widen the communication frequency band, it requires to increase more radiation portions, thereby resulting in complexity of the antenna structure in design and manufacturing.

In patents CN102683829, CN104701609 and CN103403962, although a coupling feed mode is used, antenna structures disclosed in those patents all take a coupling portion as a certain radiation portion, in other words, the coupling portion has the function of the radiation portion. As such, it is not beneficial to optimize an overall performance of the antenna. Because when a length of the coupling portion is adjusted, impedances of other radiation portions will be also affected due to this adjustment. Therefore, deficiencies of the antenna devices in those patents lie in that a volume of the antenna device is relative large, and a design of the antenna device is relative complex.

The description in background as above merely is used to provide a background art, and it does not admit that the description on the background art as above discloses the object of the present disclosure, and do not constitute a prior art of the present disclosure, and any description in background as above shall not be acted as any part of the present disclosure.

SUMMARY

In an embodiment of the present disclosure, an antenna device is provided. The antenna device comprises a carrier, a first radiation portion, a second radiation portion and a coupling portion. The first radiation portion, the second radiation portion and the coupling portion are provided on the carrier. The second radiation portion electrically connects with the first radiation portion, the first radiation portion and the second radiation portion share a shared part, the shared part is directly connected to a grounding face. The coupling portion capacitively couples an electrical signal to the first radiation portion and the second radiation portion. The first radiation portion and the second radiation portion convert the electrical signal into a radiation signal emitted by the antenna device.

In an embodiment, the shared part physically contacts a grounding line, the grounding line is electrically connected to the grounding face.

In another embodiment, the coupling portion is insulated from the first radiation portion and the second radiation portion.

In an embodiment of the present disclosure, the coupling portion is independent of the first radiation portion and the second radiation portion.

In another embodiment, a length of the coupling portion is less than one fourth of a wavelength corresponding to an operative frequency of the radiation signal, so as to allow the coupling portion to be only used to adjust an impedance of antenna device, and to transfer energy to the first radiation portion and the second radiation portion, but not to act as the radiation portion to radiate the radiation signal.

In still another embodiment, a length of the first radiation portion determines a low frequency resonance point and a first high frequency resonance point of the radiation signal, a length of the second radiation portion determines a second high frequency resonance point of the radiation signal.

In yet another embodiment, the first radiation portion has a side edge, the side edge defines a slot, an inner edge length of the slot is a part of a length of the first radiation portion.

In further another embodiment, the inner edge length of the slot determines a low frequency resonance point and a first high frequency resonance point of the radiation signal.

In an embodiment, a material of the carrier is ceramic.

In an embodiment, a patterned conductive layer defining the first radiation portion, the second radiation portion and the coupling portion is formed on the ceramic by a silver firing method.

In another embodiment, a material of the carrier is plastic.

In still another embodiment, a patterned conductive layer defining the first radiation portion, the second radiation portion and the coupling portion is form on the plastic by using a plastic having a high dielectric constant in combination with a laser directly structure (LDS) method.

In another embodiment, the first radiation portion, the second radiation portion and the coupling portion all are rectangle patterns and are provided on the carrier.

In still another embodiment, the first radiation portion and the second radiation portion constitute a radiator, the radiator and the coupling portion define a first capacitor, the coupling portion and a reference grounding define a second capacitor, the radiator and the reference grounding define a third capacitor, the first capacitor, the second capacitor and the third capacitor determine a frequency bandwidth of the radiation signal.

In an embodiment of the present disclosure, the carrier is a rectangular parallelepiped.

In an embodiment of the present disclosure, the rectangular parallelepiped has an upper surface, a lower surface, a front surface, a rear surface, a left surface and a right surface, the first radiation portion and the second radiation portion constitute a radiator, the radiator and the coupling portion at least respectively continuously extend on the lower surface, the front surface, the upper surface and the rear surface.

In an embodiment of the present disclosure, an antenna device is provided. The antenna device comprises a carrier and a first radiation portion. The first radiation portion is provided on the carrier. A side edge of the first radiation portion defines a slot, a low frequency resonance point of the radiation signal emitted by the antenna device is a function of an inner edge length of the slot. A first high frequency resonance point of the radiation signal is a function of the inner edge length of the slot.

In an embodiment of the present disclosure, a relationship between the low frequency resonance point of the radiation signal and the slot is expressed as follows:

$$f1 = \frac{C}{4(S\sqrt{\varepsilon})}$$

where f1 represents the low frequency resonance point, C represents a propagation velocity of light in vacuum, S represents the length of the first radiation portion, where the inner edge length of the slot is a part of the length of the first radiation portion, ε is a dielectric constant of the carrier.

In an embodiment of the present disclosure, a relationship between the first high frequency resonance point of the radiation signal and the slot is expressed as follows:

$$f2 = \frac{3C}{4(S\sqrt{\varepsilon})}$$

where f2 represents the second high frequency resonance point, C represents a propagation velocity of light in vacuum, S represents the length of the first radiation portion, where the inner edge length of the slot is a part of the length of the first radiation portion, ε is a dielectric constant of the carrier.

In patent CN102623801, a direct feed design is used, which results in a deficiency that a communication frequency band is relative narrow. In order to widen the communication frequency band, it requires to increase more radiation portions, thereby resulting in complexity of the antenna structure in design and manufacturing.

In patents CN102683829, CN104701609 and CN103403962, although a coupling feed mode is used, antenna structures disclosed in those patents all take a coupling portion as a certain radiation portion, in other words, the coupling portion has the function of the radiation portion. As such, it is not beneficial to optimize an overall performance of the antenna. Because when a length of the coupling portion is adjusted, impedances of other radiation portions will be also affected due to this adjustment, compatibility between them is relatively difficult. Therefore, deficiencies of the antenna devices in those patents lie in that a volume of the antenna device is relative large, and a design of the antenna device is relative complex.

Comparatively, the antenna device of the present disclosure uses a coupling feed mode, therefore the antenna device has a wider bandwidth, overcomes deficiencies of the direct feed mode. Moreover, the coupling portion of the antenna device of the present disclosure is designed so that the coupling portion does not act as the radiation portion (namely does not have the function of the radiation portion), the coupling portion of the present disclosure only acts as an energy converter and functions as adjusting the impedance. By adjusting the length of the coupling portion, an impedance of the radiation signal of the radiator (constituted by at least a radiation portion) at a resonance frequency can better controlled, so as to make the impedance of the radiator better matched with 50 ohm. By designing the shape of the radiation portion determining the low frequency resonance point, definitely, by opening a slot, it may allow the multiple frequency resonance of the low frequency resonance point to be within a range desired by the present disclosure. In other words, the operative frequency band of the antenna device can be widen without increasing the size of the antenna device.

Technical features and advantages of the present disclosure are widely summarized as above, so as to better understand the following detailed description. Other technical feature making up technical solutions of the claims of the present disclosure and other advantages will be described below. A person skilled in the art of the present disclosure shall understand that the concept and specific embodiments disclosed below may be easily used to modify or design other configuration or manufacturing approach so as to realize the same object as the present disclosure. A person skilled in the art of the present disclosure shall also understand that, such an equivalent configuration or approach cannot be departed from the spirit and scope of the present disclosure defined by the appended claims.

BRIEF DESCRIPTION OF THE DRAWINGS

The various respects of the present disclosure may be best understood by the following detailed description taken in connection with the accompanying Figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclose content provides various embodiments or exemplifications used to implement various features of the present disclosure. Specific examples of elements and arrangements are described as follows, so as to simplify the disclosed content of the present disclosure. Certainly, these are merely examples, and are not used to limit the present disclosure. For example, in the following description, that a first feature is formed on or above a second feature may comprise an embodiment that the first feature and the second are formed to directly contact with each other, may also comprise an embodiment that other feature is formed between the first feature and the second feature, therefore the first feature and the second feature do not directly contact with each other. Moreover, the present disclosure may allow a symbol and/or a character of an element to be repeated in different examples. The repetition is used for simplification and clearness, but is not used to dominate a relationship between various embodiments and/or discussed structures.

Moreover, the present disclosure may use spatial corresponding terminologies, such as "below", "lower than", "relative lower", "higher than", "relative high" and the like, so as to describe a relationship between an elements or feature and another element or feature. Spatial corresponding terminologies are used to comprise various orientations of a device in use or operation besides orientations illustrated in Figures. Or the device may be orientated (rotated by 90 degrees or at other orientation), and the corresponding spatial description in the present disclosure may be correspondingly explained. It should be understood that, when a feature is formed to another feature or above a substrate, other features may presented between them.

Figure 1:
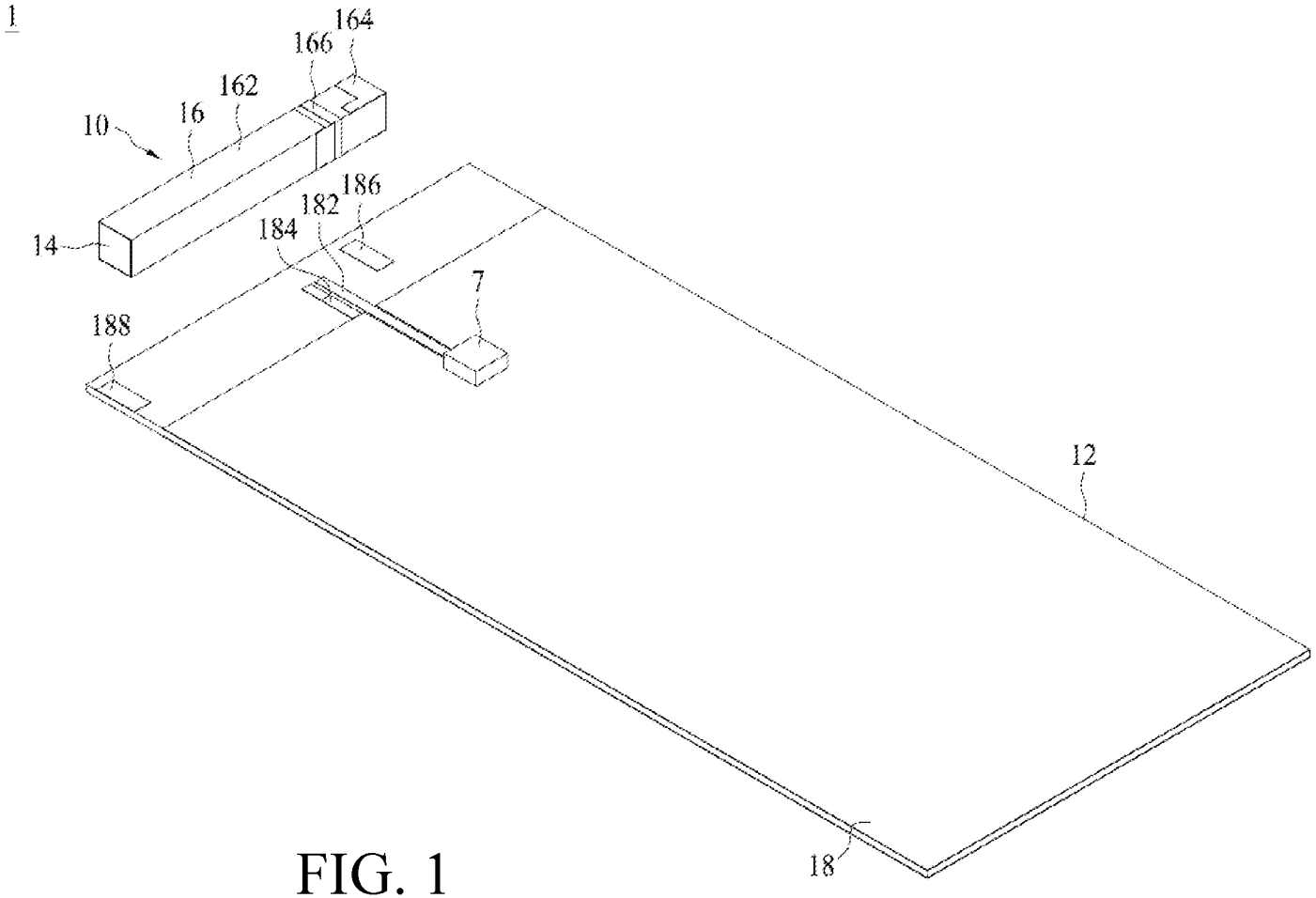
FIG. 1 is a diagrammatic view of components of an antenna equipment of an embodiment of the present disclosure.

FIG. 1 is a diagrammatic view of components of an antenna equipment 1 of an embodiment of the present disclosure emitting a radiation signal. In an embodiment, the antenna equipment 1 is an antenna equipment conformed with the long term evolution (LTE), the long term evolution is a high speed wireless communication standard applied to mobile phones and data card terminals.

Referring to FIG. 1, the antenna equipment 1 comprises an antenna device 10 and a substrate 12. The antenna device 10 is provided on the substrate 12 via an engaging pad 186 and an engaging pad 188 on the substrate 12. The antenna device 10 comprises a carrier 14 and a patterned conductive layer 16. The patterned conductive layer 16 is provided on the carrier 14. In an embodiment, the carrier 14 is a rectangular parallelepiped, and has an upper surface, a lower surface, a front surface, a rear surface, a left surface and a right surface.

In an embodiment, a material of the carrier 14 is ceramic, the patterned conductive layer 16 is provided on the carrier 14 which is ceramic by using a silver covering method. The silver covering method is also referred to as a silver firing method, and refers to that a layer of sliver is formed on a surface of the ceramic by firing and infiltrating, that is metal powders are coated on the surface of the ceramic, with a high temperature processing, a metal film adhered on the surface of the ceramic via glasses is formed. The silver covering method is a mature ceramic surface metallization method, and a manufacturing process thereof comprises steps of preprocessing the ceramic, preparing a sliver slurry, coating and firing sliver which are sequentially performed, after the step of firing sliver, a final product is obtained.

In another embodiment, a material of the carrier 14 is plastic, the patterned conductive layer 16 uses a plastic having a high dielectric constant (the high dielectric constant refers to, for example, that the dielectric constant is higher than 8) in combination with a laser direct structure (LDS) method and is formed and provided on the carrier 14 which is plastic by means of electroplating or electroless plating.

The patterned conductive layer 16 defines a first radiation portion 162, a second radiation portion 164 and a coupling portion 166. The coupling portion 166 provided on the carrier 14 is electrically connected to a transceiver 7 via a transmitting line 182, so as to receive an electrical signal from the transceiver 7, the transceiver 7 is a device having receiving and emitting capability. In some embodiments, the transceiver 7 is an integrated chip of a product. Moreover, the coupling portion 166 capacitively couples the electrical signal to the first radiation portion 162 and the second radiation portion 164.

Both the first radiation portion 162 and the second radiation portion 164 are provided on the carrier 14 and constitute a radiator. The first radiation portion 162 and the second radiation portion 164 are connected to a grounding face 18, which acts as a reference grounding and is provided on the substrate 12, via a grounding line 184. The first radiation portion 162 and the second radiation portion 164 convert the electrical signal into the radiation signal. The first radiation portion 162 determines a low frequency resonance point and a first high frequency resonance point of the radiation signal. The second radiation portion 164 determines a second high frequency resonance point of the radiation signal. In an embodiment, the second high frequency resonance point is higher than the first high frequency resonance point.

Figure 2A:
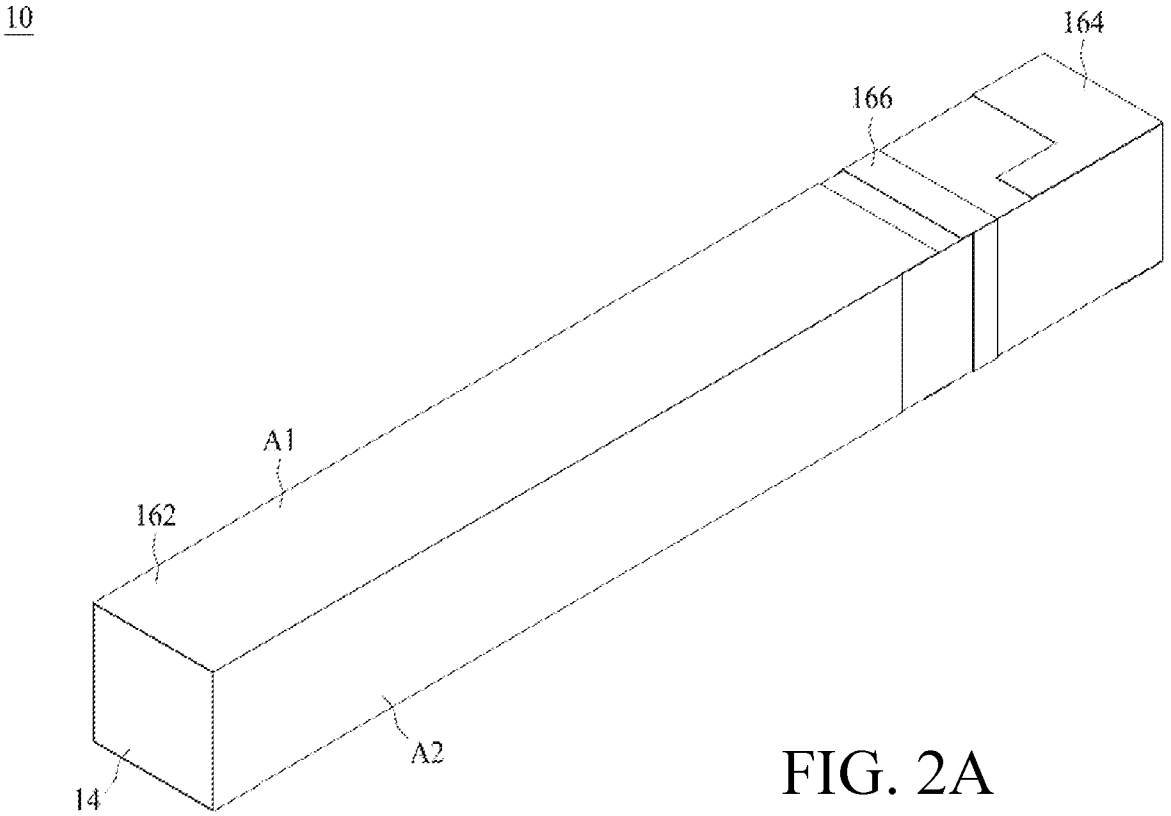
FIG. 2A is a perspective view of an antenna device in FIG. 1 viewed from a side.

FIG. 2A is a perspective view of the antenna device 10 in FIG. 1 viewed from a side. Referring to FIG. 2A, the first radiation portion 162 extends onto a first surface A1 (which may be deemed as the upper surface of the carrier 14) and a second surface A2 (which may be deemed as the front surface of the carrier 14) of the carrier 14, the first surface A1 is adjacent to the second surface A2. In an embodiment, the first surface A1 is orthogonal to the second surface A2. The second radiation portion 164 extends onto the first surface A1 of the carrier 14. The coupling portion 166 extends onto the first surface A1 and the second surface A2 of the carrier 14.

Figure 2B:
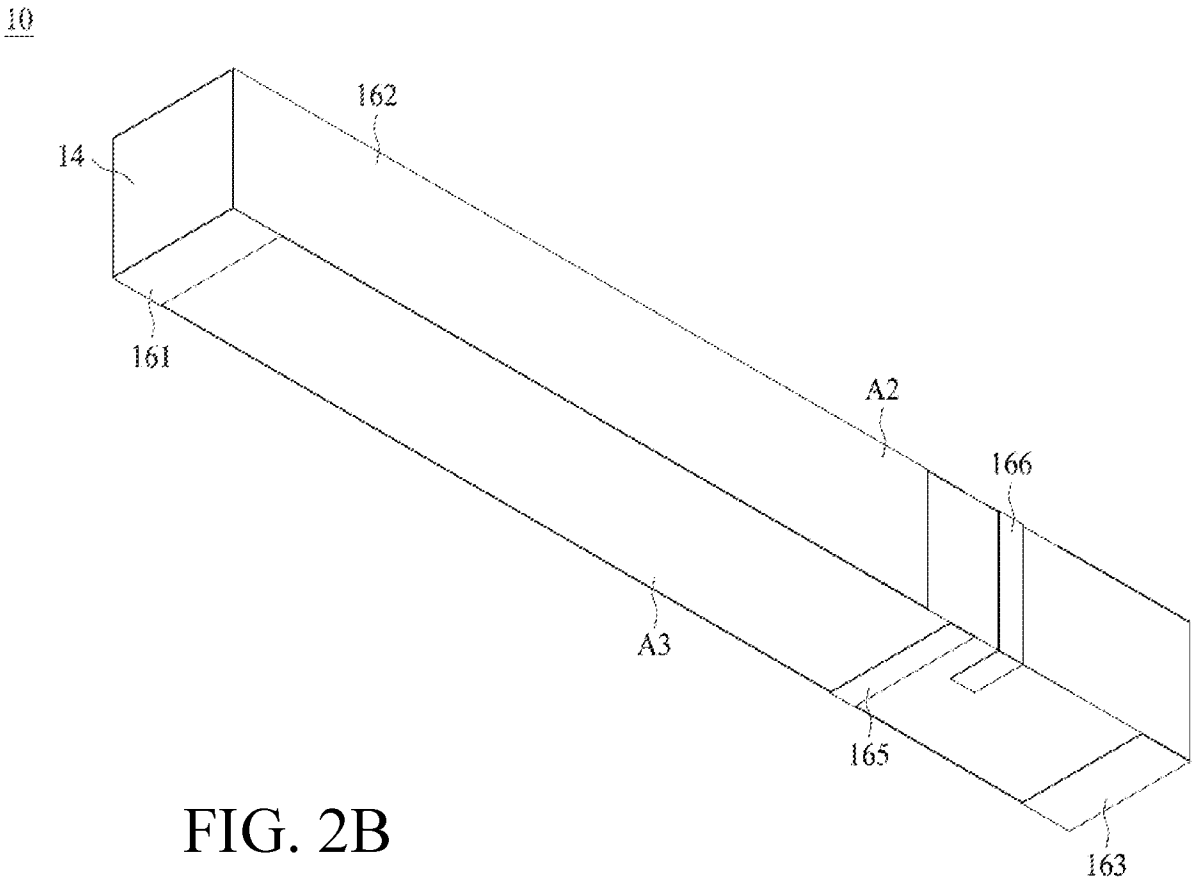
FIG. 2B is another perspective view of the antenna device in FIG. 1 viewed from another side.

FIG. 2B is another perspective view of the antenna device 10 in FIG. 1 viewed from another side. Referring to FIG. 2B, a shared part 165 which is shared by the first radiation portion 162 and the second radiation portion 164 extends onto a third surface A3 (which may be deemed as the lower surface of the carrier 14). The third surface A3 is adjacent to the second surface A2. In an embodiment, the third surface A3 is orthogonal to the second surface A2, and is opposite to the first surface A1. The shared part 165 has the function of the radiation portions. Moreover, the shared part 165 physically contacts the grounding line 184 in FIG. 1 and is connected to the grounding face 18 as the reference grounding via the grounding line 184. The coupling portion 166 extends onto the second surface A2 and the third surface A3 of the carrier 14. A part of the coupling portion 166 which extends onto the third surface A3 physically contacts the transmitting line 182 in FIG. 1, so as to receive the electrical signal from the transceiver 7.

Moreover, an element 161 and an element 163 are provided on the third surface A3 of the carrier 14. Although the element 161 extends from the first radiation portion 162 and physically contacts the first radiation portion 162, the element 161 does not have the function of the radiation portions. The element 161 and the element 163 fix the antenna device 10 to the substrate 12 in FIG. 1. For example, the element 161 and the element 163 are respectively attached to the engaging pad 188 and the engaging pad 186 by soldering operation.

Figure 2C:
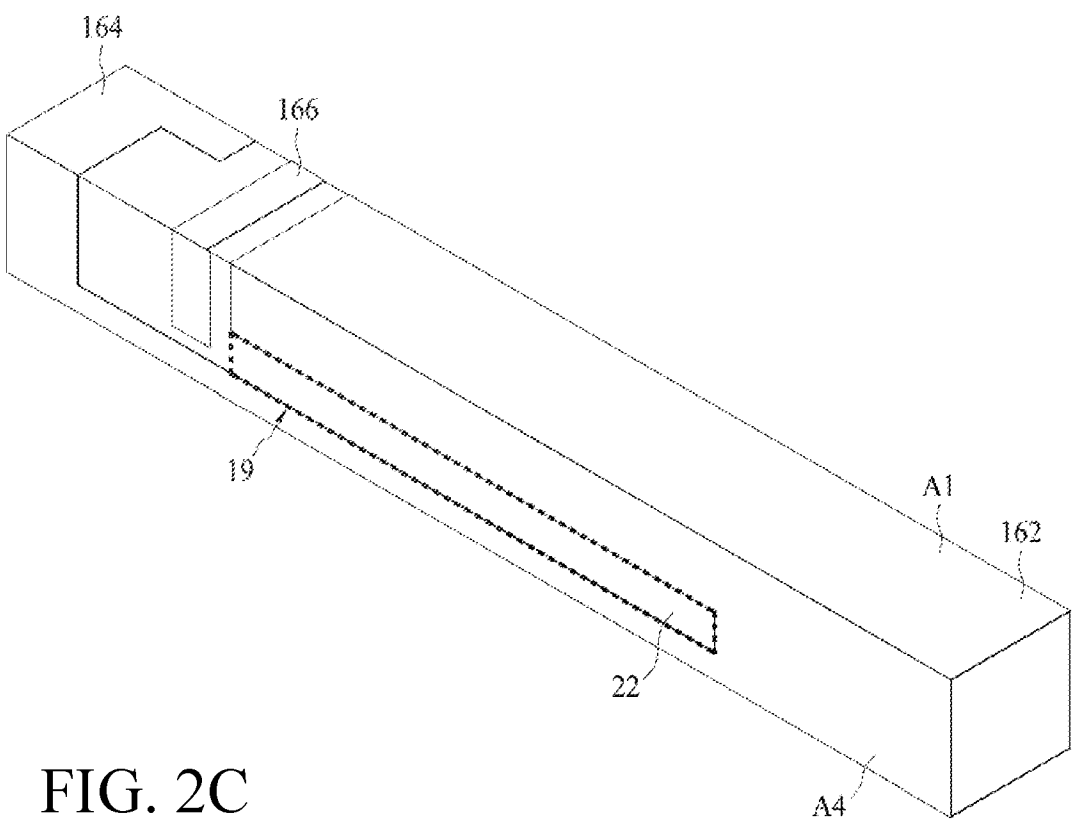
FIG. 2C is still another perspective view of the antenna device in FIG. 1 viewed from still another side.

FIG. 2C is still another perspective view of the antenna device 10 in FIG. 1 viewed from still another side. Referring to FIG. 2C, the coupling portion 166 extends onto the first surface A1 and a fourth surface A4 (which may be deemed as the rear surface of the carrier 14), the fourth surface A4 is adjacent to the first surface A1. In an embodiment, the fourth surface A4 is orthogonal to the first surface A1. The second radiation portion 164 extends onto the first surface A1 and the fourth surface A4.

The first radiation portion 162 extends onto the first surface A1 and the fourth surface A4. A side edge 19 of the first radiation portion 162 positioned on the fourth surface A4 defines a slot 22. The slot 22 determines the low frequency resonance point and the first high frequency resonance point of the radiation signal, and will be shown in detail in FIG. 3. In an embodiment of the present disclosure, a shape of the slot 22 is a rectangle, however, the present disclosure is not limited to this.

Figure 3:
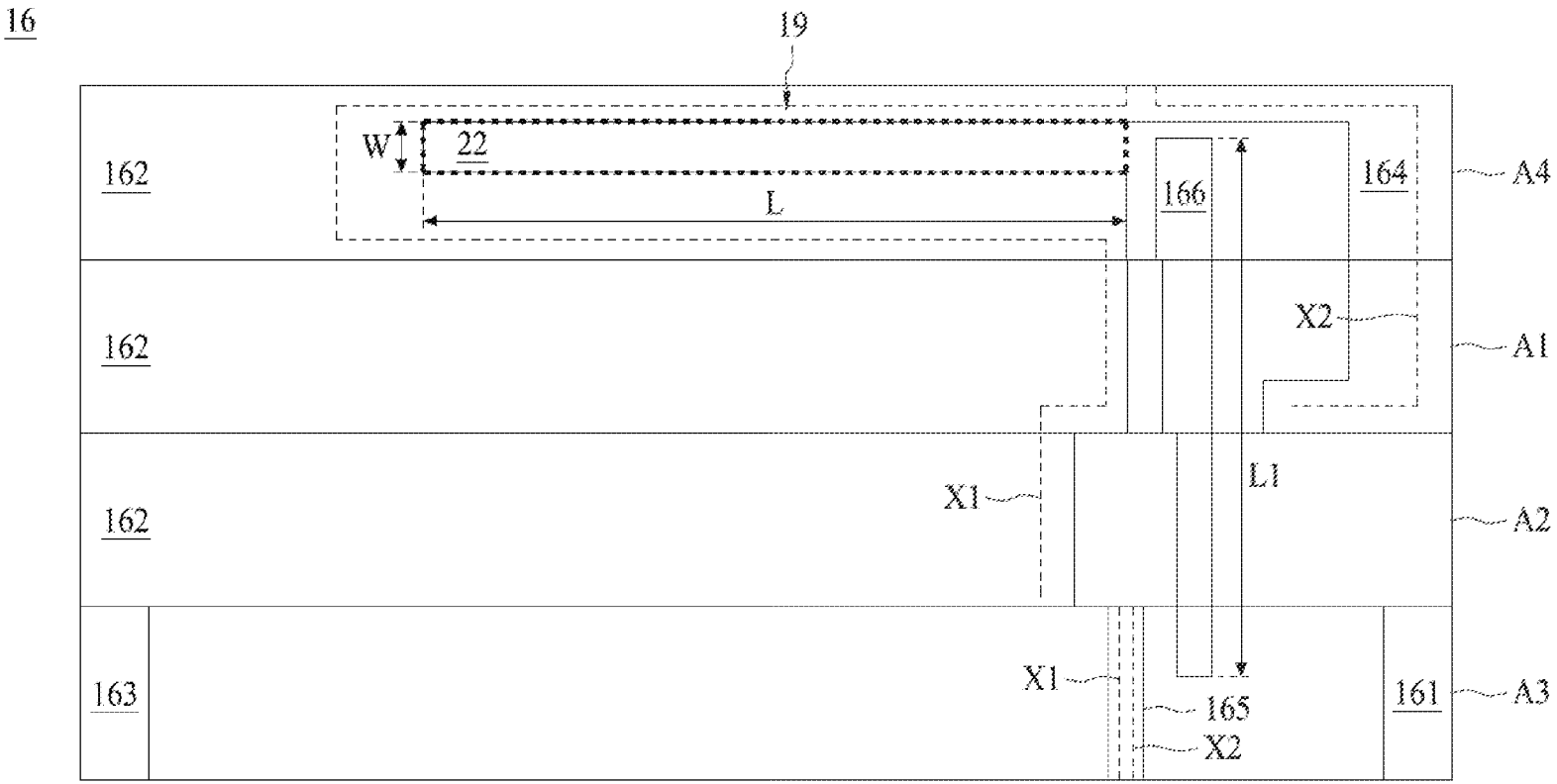
FIG. 3 is a diagrammatic view of a patterned conductive layer in FIG. 1 after developed.

FIG. 3 is a diagrammatic view of the patterned conductive layer 16 of the antenna device 10 in FIG. 1 after developed. Referring to FIG.3, in order to clearly understand a pattern of the patterned conductive layer 16, the patterned conductive layer 16 positioned on the first surface A1, the second surface A2, the third surface A3 and the fourth surface A4 of the carrier 14 is developed on the same plane. Although the third surface A3 and the fourth surface A4 are drawn as two opposite surfaces, however in practice, the third surface A3 is adjacent to the fourth surface A4.

As described above, the shared part 165 which is shared by the first radiation portion 162 and the second radiation portion 164 is connected to the grounding face 18. A current flowing through the first radiation portion 162 and a current flowing through the second radiation portion 165 will flow to the grounding face 18 via the shared part 165. Therefore, the shared part 165 defines the first radiation portion 162 and the second radiation portion 164. Definitely, a radiation portion positioned at one side of the shared part 165 is the first radiation portion 162, a radiation portion positioned at the other side of the shared part 165 is the second radiation portion 164. Moreover, because the first radiation portion 162 and the second radiation portion 164 share the shared part 165, the first radiation portion 162 and the second radiation portion 164 are incorporated together. The coupling portion 166 is independent of each of the first radiation portion 162 and the second radiation portion 164.

The first radiation portion 162 has a length X1. The length X1 of the first radiation portion 162 may be deemed as a sum of an inner edge length of the slot 22 and lengths of edges of a side of the first radiation portion 162 which is close to the coupling portion 166. The length X1 of the first radiation portion 162 determines the low frequency resonance point and the first high frequency resonance point of the radiation signal. The length X1 of the first radiation portion 162 is one fourth of a wavelength corresponding to the low frequency resonance point. Moreover, the length X1 of the first radiation portion 162 is three fourths of a wavelength corresponding to the first high frequency resonance point. The first high frequency resonance point is a triple-frequency of the low frequency resonance point.

The slot 22 has a width W and a length L, so that the inner edge length of the slot 22 is 2W+L. A relationship between the low frequency resonance point and the inner edge length of the slot 22 may be expressed by a following equation 1.

$$f1 = \frac{C}{4(S\sqrt{\varepsilon})} \qquad \text{Equation 1}$$

where f1 represents the low frequency resonance point, C represents a propagation velocity of light in vacuum, S represents the length X1 of the first radiation portion 162, where the inner edge length of the slot 22 is a part of the length X1 of the first radiation portion 162, ε is a dielectric constant of the carrier 14.

As can be seen from Equation 1, the low frequency resonance point of the radiation signal is a function of the inner edge length of the slot 22. When the inner edge length of the slot 22 is changed, the low frequency resonance point of the radiation signal is also changed. Therefore, it may adjust the low frequency resonance point of the radiation signal by adjusting the length L and/or the width W of the slot 22. When longer the inner edge length of the slot 22 is, lower an obtained frequency of the low frequency resonance point is.

Moreover, a relationship between the first high frequency resonance point of the radiation signal and the inner edge length of the slot 22 may be expressed by a following equation 2.

$$f2 = \frac{3C}{4(S\sqrt{\varepsilon})} \qquad \text{Equation 2}$$

where f2 represents the first high frequency resonance point.

As can be seen from Equation 2, the first high frequency resonance point of the radiation signal is a function of the inner edge length of the slot 22. When the inner edge length of the slot 22 is changed, the first high frequency resonance point of the radiation signal is also changed. Therefore, it may adjust the first high frequency resonance point of the radiation signal by adjusting the length L and/or the width W of the slot 22. When longer the inner edge length of the slot 22 is, lower an obtained frequency of the first high frequency resonance point is.

Because the slot 22 is defined by a side edge 19 of the first radiation portion 162 close to the coupling portion 166 and the length X1 of the first radiation portion 16 also is a sum of lengths of edges at a side which is close to the coupling portion 166, therefore the length X1 of the first radiation portion 16 comprises the inner edge length of the slot 22.

Moreover, in the embodiment, the slot 22 is provided on the fourth surface A4. However, the present disclosure is not limited to this, the slot 22 may be provided on one of the first surface A1 and the second surface A2.

The second radiation portion 164 has a length X2. The length X2 of the second radiation portion 164 may be deemed as a sum of lengths of edges of a side of the second radiation portion 164 which is close to the coupling portion 166. The length X2 of the second radiation portion 164 determines the second high frequency resonance point of the radiation signal. The length X2 of the second radiation portion 164 is one fourth of a wavelength corresponding to the second high frequency resonance point. Therefore, it may adjust a resonance frequency of the second high frequency resonance point by adjusting the length X2 of the second radiation portion 164.

The coupling portion 166 has a length L1. The length L1 of the coupling portion 166 is designed to be less than one fourth of a wavelength corresponding to an operative frequency (for example, the low frequency resonance point, the first high frequency resonance point or the second high frequency resonance point), so as to allow the coupling portion 166 to be used only for adjusting an impedance of the antenna device 10 and to transfer energy to the first radiation portion 162 and the second radiation portion 164, and not to act as the radiation portion to radiate the radiation signal. In the present disclosure, the coupling portion 166 is only used to convert the electrical signal into the radiation signal, namely acts as a transferring element for energy.

Moreover, because the first radiation portion 162, the second radiation portion 164, the coupling portion 166 extend on the four surfaces (the first surface A1, the second surface A2, the third surface A3 and the fourth surface A4) of the carrier 14, the antenna device 10 is three dimensionalized. Therefore, a size of the antenna device 10 can be further reduced in dimension.

Figure 4A:
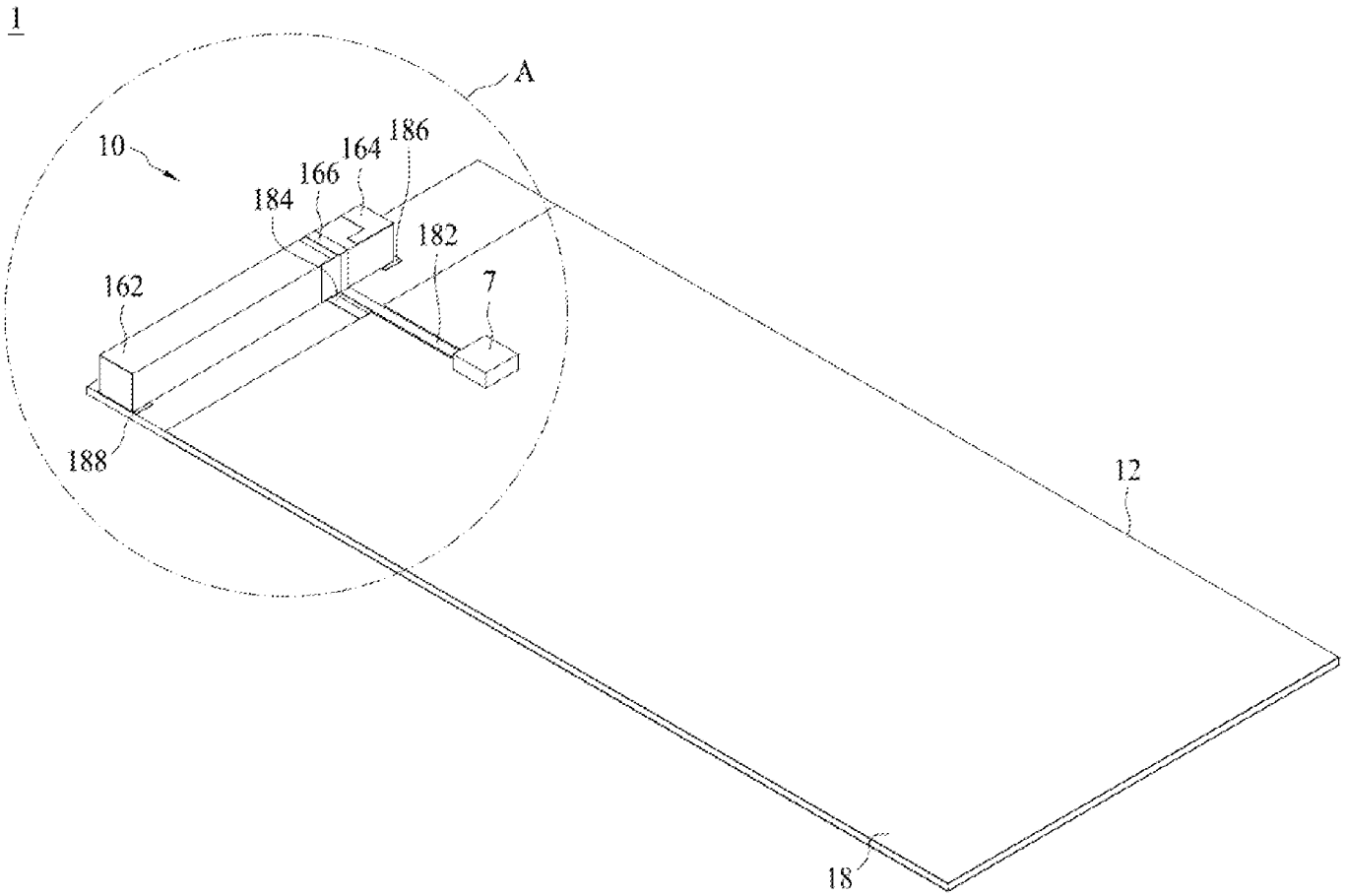
FIG. 4A is a diagrammatic view of an antenna equipment of an embodiment of the present disclosure.

FIG. 4A is a diagrammatic view of an antenna equipment 1 of an embodiment of the present disclosure. Referring to FIG. 4A, the antenna device 10 is fix to a substrate 12 to constitute the antenna equipment 1. The antenna device 10 receives an electrical signal from a transceiver 7, and converts an electrical signal into a radiation signal, and emits the radiation signal.

Figure 4B:
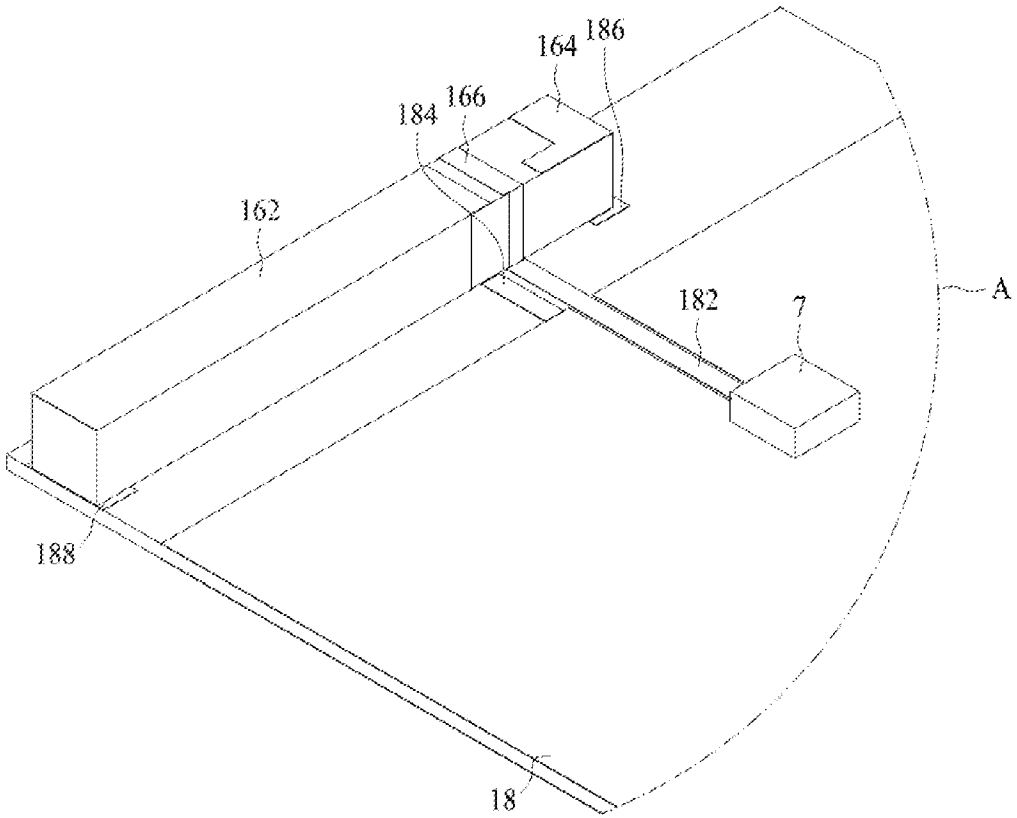
FIG. 4B is a partially enlarged view of a region in FIG. 4A viewed from a side.

FIG. 4B is a partially enlarged view of a region A in FIG. 4A viewed from another side. Referring to FIG. 4B, FIG. 4B clearly illustrates a connection between the antenna device 10 and a transmitting line 182 and a grounding line 184 in structure.

Figure 4C:
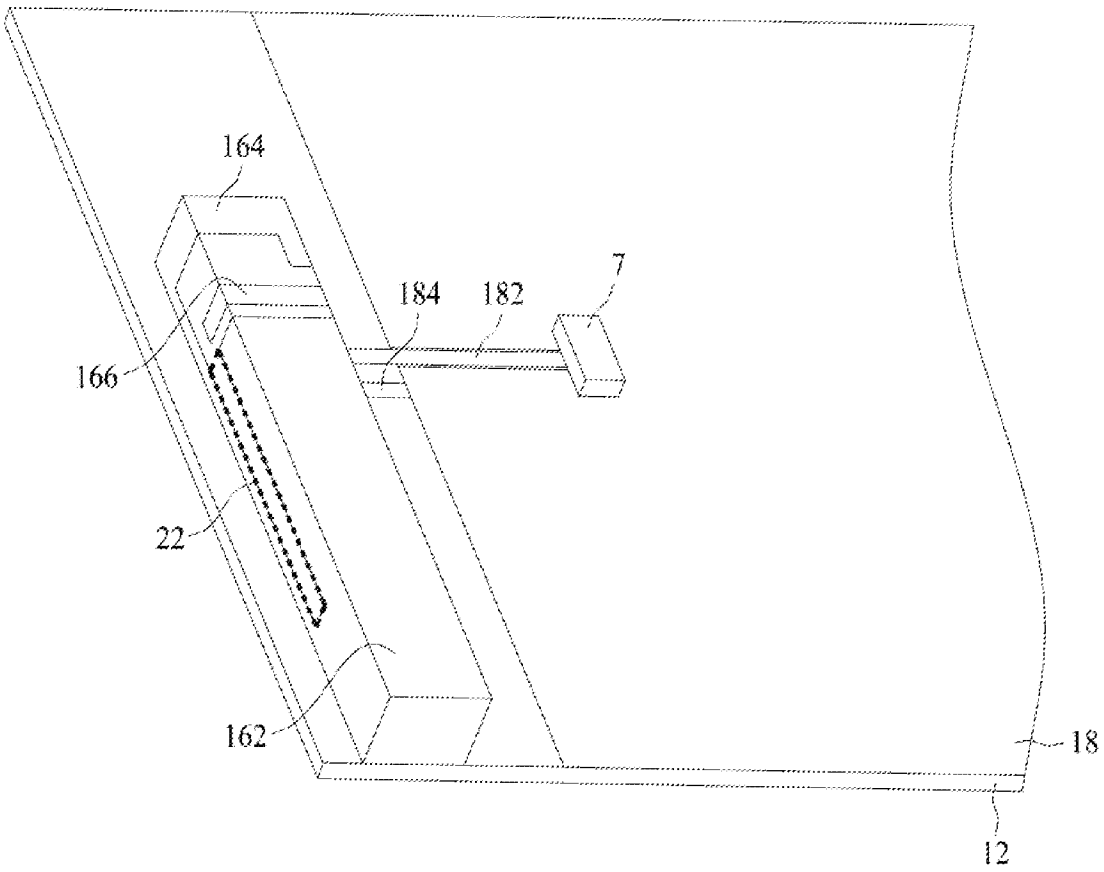
FIG. 4C is a partially enlarged view of the region in FIG. 4A viewed from another side.

FIG. 4C is another partially enlarged view of the region A in FIG. 4A. Referring to FIG. 4C, FIG. 4C clearly illustrates a pattern of a slot 22 defined by a side edge 19 of a first radiation portion 162.

Figure 5:
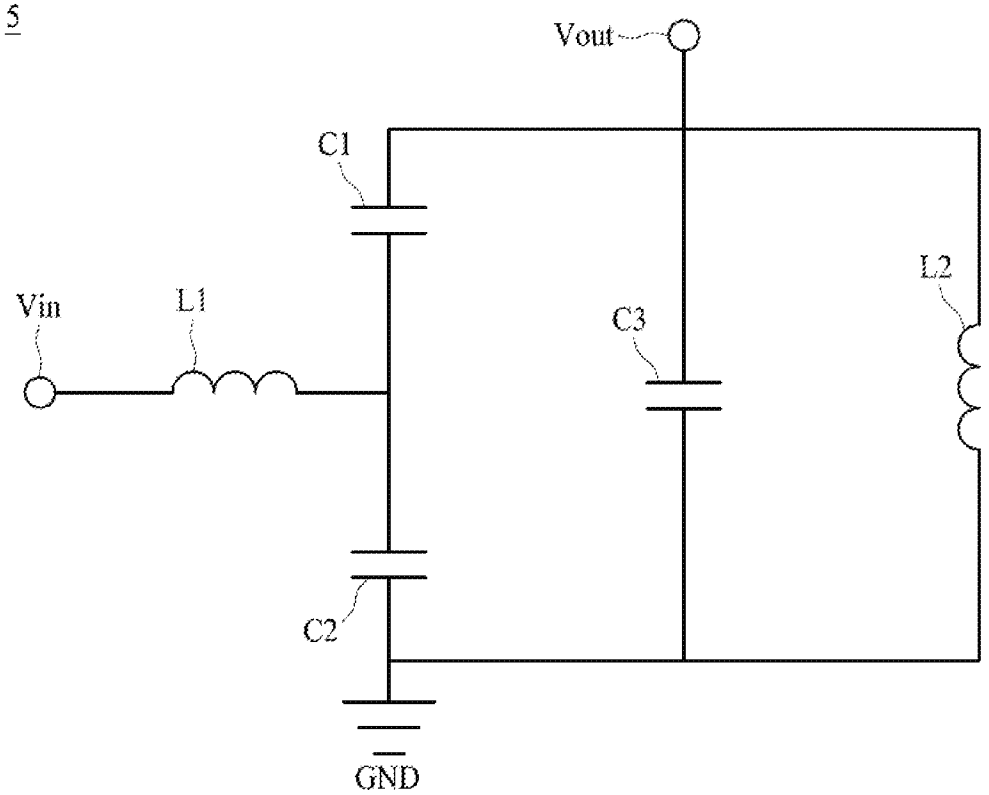
FIG. 5 is a circuit diagram of an equivalent circuit of an antenna device in FIG. 4A.

FIG. 5 is a circuit diagram of an equivalent circuit 5 of the antenna device 10 in FIG. 4A. Referring to FIG. 5, the equivalent circuit 5 has an input end Vin receiving the electrical signal and an output end Vout outputting the radiation signal. The equivalent circuit 5 comprises an inductor L1, an inductor L2, a capacitor C1, a capacitor C2 and a capacitor C3.

The inductor L1 is an equivalent inductor of a coupling portion 166 itself. The capacitor C1 is a capacitor defined by a radiator constituted by the first radiation portion 162 and a second radiation portion 164 and the coupling portion 166. The capacitor C2 is a capacitor defined by the coupling portion 166 and a grounding face 18. The capacitor C3 is a capacitor defined by the radiator constituted by the first radiation portion 162 and the second radiation portion 164 and the grounding face 18. The inductor L2 is an equivalent inductor of the grounding line 184 itself.

The inductor L1, the capacitor C1 and the capacitor C2 all are associated with the coupling portion 166. Therefore, a shape and a position of the coupling portion 166 directly affect the inductor L1, the capacitor C1 and the capacitor C2. The inductor L1, the capacitor C1 and the capacitor C2 are adjusted by adjusting the shape and the position of the coupling portion 166, an impedance of a resonance frequency of the antenna device 10 may be optimized. Moreover, the capacitor C1, the capacitor C2 and the capacitor C3 determine the impedance of the antenna device 10.

Moreover, the impedance of the antenna device 10 may be adjusted by adjusting the inductor L1, which is shown in detail in embodiments in FIG. 7A, FIG. 7B, FIG. 7C and FIG. 7D. In the present disclosure, the length L1 of the coupling portion 166 is only used to adjust the impedance of the antenna device 10, is not used to determine the frequency resonance points of the radiation signal. The length L1 of the coupling portion 166 does not significantly affect the frequency resonance points. Therefore, the length L1 of the coupling portion 166 is not constrained by a frequency desired by the radiation signal emitted by the antenna device 10. As such, it is more convenient to debug the impedance of the antenna device 10.

Figure 6:
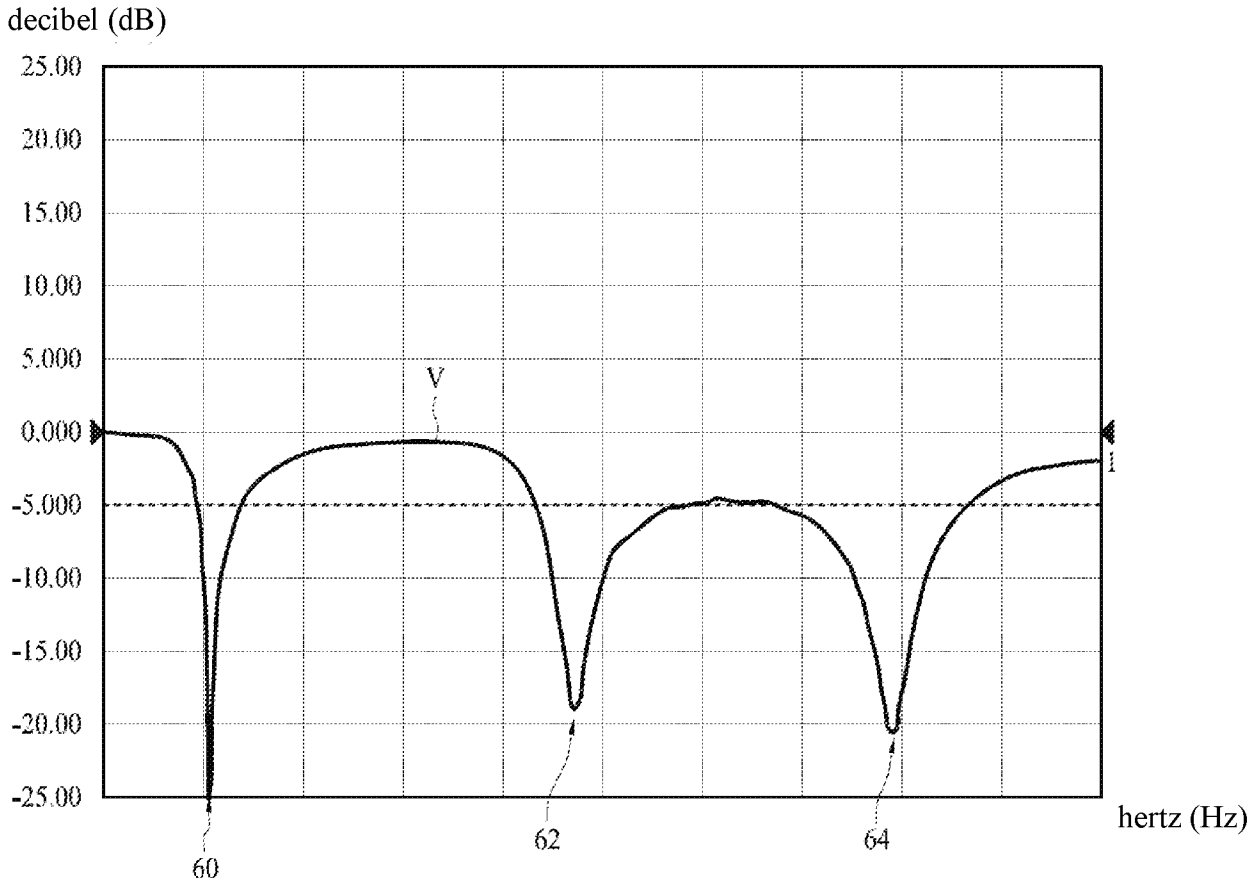
FIG. 6 is a return loss diagram of the antenna device in FIG. 4A.

FIG. 6 is a return loss diagram of the antenna device 10 in FIG. 4A. Referring to FIG. 6, a horizontal axis is frequency and a vertical axis is decibel (db). A curve V has a low frequency resonance point 60, a first high frequency resonance point 62 and a second high frequency resonance point 64. The low frequency resonance point 60 defines a low frequency range of about 698 MHz to about 960 MHz required by the LTE standard. The first high frequency resonance point 62 and the second high frequency resonance point 64 define a high frequency range of about 1710 MHz to about 2690 MHz required by the LTE standard.

Figure 7A:
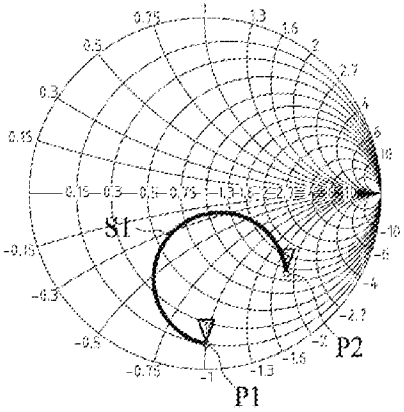
FIGS. 7A-7D are smith impedance plots of the antenna device in FIG. 4A.
Figure 7B:
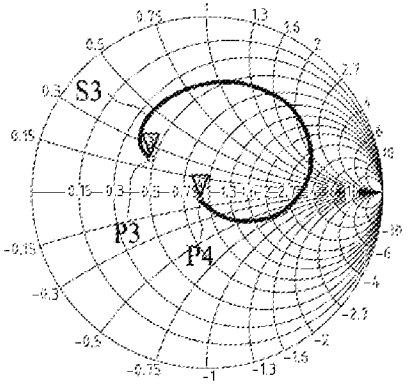
Figure 7C:
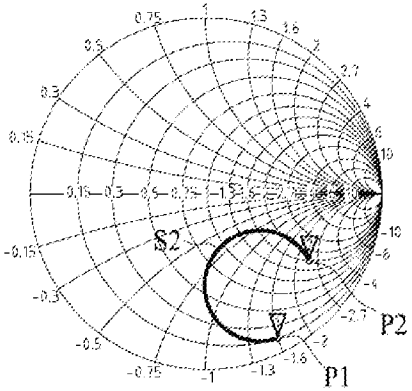

FIG. 7A, FIG. 7B, FIG. 7C and FIG. 7D are smith impedance plots of the antenna device 10 in FIG. 4A. Referring to FIG. 7A, a curve S1 represents a case that the coupling portion 166 is at an original length thereof, a point P1 and a point P2 respectively represent a low frequency of 698 MHz and a low frequency of 960 MHz required by the LTE standard. Referring to FIG. 7C, a curve S2 represents a case that the coupling portion 166 is reduced relative to the original length by 2 mm. As can be understood from comparison between the curve S1 and the curve S2, under that a bandwidth of the radiation signal is essentially not changed, changing the length L1 of the coupling portion 166 will significantly change the impedance of the antenna device 10 at the low frequency required by the LTE standard.

Figure 7D:
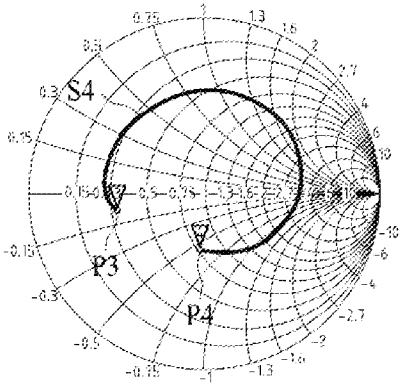

Referring to FIG. 7B, a curve S3 represents a case that the coupling portion 166 is at the original length thereof, a point P3 and a point P4 respectively represent a high frequency of 1710 MHz and a high frequency of 2700 MHz required by the LTE standard. Referring to FIG. 7D, a curve S4 represents a case that the coupling portion 166 is reduced relative to the original length by 2 mm. As can understood from comparison between the curve S3 and the curve S4, under that a bandwidth of the radiation signal is essentially not changed, changing the length L1 of the coupling portion 166 significantly changes the impedance of the antenna device 10 at the high frequency required by the LTE standard. Therefore, the impedance of the antenna device 10 may be adjusted by adjusting the length L1 of the coupling portion 166, so as to allow the impedance of the antenna device 10 and an impedance of the transmitting line 182 to be matched in impedance.

Moreover, as described above, changing the length L1 of the coupling portion 166 does not significantly change the return loss. Therefore, when the impedance of the antenna device 10 is adjusted by adjusting the length of the coupling portion 166, it need not worry about the undesirable affect on the return loss. Because the coupling portion 166 is only used to adjust the impedance, the design of the antenna device 10 is simplified.

In the present disclosure, the antenna device 10 has the first radiation portion 162, the second radiation portion 164 and the coupling portion 166. The first radiation portion 162 determines the low frequency resonance point and the first high frequency resonance point of the radiation signal at the desired frequency band. The second radiation portion 164 determines the desired second high frequency resonance point of the radiation signal. Feed (capacitive coupling) performed with the capacitor defined by the coupling portion 166 and the first radiation portion 162 and the second radiation portion 164 is beneficial to obtain an enough bandwidth, realizes the object of miniaturizion and multiple frequency bands of the antenna device 10 in design.

Moreover, the patterned conductive layer 16 in the present disclosure is provided on the surfaces of the carrier 14. The carrier 14 is made of ceramic having a high dielectric constant (the high dielectric constant refers to, for example, that the dielectric constant is higher than 8), or plastic material, therefore a size of the antenna device 10 is further reduced.

In addition, by designing a pattern of the first radiation portion 162 determining the low frequency resonance point (that is, form one slot 22), a multiple frequency resonance of the low frequency resonance point may be within a range desired by the radiation signal (a second harmonic of the low frequency resonance point just fall within the desired frequency range), so that the operative frequency band of the antenna device 10 is widen under a precondition that the size of antenna device 10 is not increased.

In patent CN102623801, a direct feed design is used, which results in a deficiency that a communication frequency band is relative narrow. In order to widen the communication frequency band, it requires to increase more radiation portions, thereby resulting in complexity of the antenna structure in design and manufacturing.

In patents CN102683829, CN104701609 and CN103403962, although a coupling feed mode is used, antenna structures disclosed in those patents all take a coupling portion as a certain radiation portion, in other words, the coupling portion has the function of the radiation portion. As such, it is not beneficial to optimize an overall performance of the antenna. Because when a length of the coupling portion is adjusted, impedances of other radiation portions will be also affected due to this adjustment, compatibility between them is relatively difficult. Therefore, deficiencies of the antenna devices in those patents lie in that a volume of the antenna device is relative large, and a design of the antenna device is relative complex.

Features of some embodiments are summarized in above content, so that a person skilled in the art may better understand various aspects of the disclosed content of the present disclosure. A person skilled in the art of the present disclosure shall understand that the disclosed content of the present disclosure may be easily used to design or modify other manufacturing approach or configuration and in turn to realize the same object and/or attain the same advantage as the embodiments of the present disclosure. A person skilled in the art of the present disclosure shall also understand that, such an equivalent approach or configuration cannot be departed from the spirit and scope of the disclosed content of the present disclosure, and a person skilled in the art may make various changes, substitutions and replacements, which are not departed from the spirit and scope of the disclosed content of the present disclosure.

What is claimed is:

1. An antenna device, comprising:

a carrier; and a patterned conductive layer provided on the carrier, the patterned conductive layer having a radiator and a coupling portion, the radiator comprising a first radiation portion, a second radiation portion and a shared part which is shared by the first and second radiation portions, the second radiation portion electrically connecting with the first radiation portion, the shared part being configured to connect to a grounding face provided on a substrate, the coupling portion capacitively coupling an electrical signal to the first radiation portion and the second radiation portion, the first radiation portion and the second radiation portion converting the electrical signal into a radiation signal emitted by the antenna device, wherein the first radiation portion has a side edge, the side edge defines a slot, an inner edge length of the slot is a part of a length of the first radiation portion, and wherein the inner edge length of the slot is sized to ensure that a low frequency resonance point and a first high frequency resonance point of the first radiation portion are correct.

2. The antenna device according to claim 1, wherein the shared part physically contacts a grounding line, the grounding line is electrically connected to the grounding face.

3. The antenna device according to claim 1, wherein the coupling portion is insulated from the first radiation portion and the second radiation portion.

4. The antenna device according to claim 1, wherein the coupling portion is independent of the first radiation portion and the second radiation portion.

5. The antenna device according to claim 1, wherein a length of the coupling portion is less than one fourth of a wavelength corresponding to an operative frequency of the radiation signal, so as to allow the coupling portion to be only used to adjust an impedance of antenna device, and to transfer energy to the first radiation portion and the second radiation portion, but not to act as the radiation portion to radiate the radiation signal.

6. The antenna device according to claim 1, wherein a length of the first radiation portion determines the low frequency resonance point and the first high frequency resonance point of the radiation signal, a length of the second radiation portion determines a second high frequency resonance point of the radiation signal.

7. The antenna device according to claim 1, wherein the first radiation portion, the second radiation portion and the coupling portion all are rectangle patterns.

8. The antenna device according to claim 1, wherein the radiator and the coupling portion define a first capacitor, the coupling portion and a reference grounding define a second capacitor, the radiator and the reference grounding define a third capacitor, the first capacitor, the second capacitor and the third capacitor determine a frequency bandwidth of the radiation signal.

9. The antenna device according to claim 1, wherein a relationship between the low frequency resonance point of the radiation signal and the slot is expressed as follows:

$$f1 = \frac{C}{4(S\sqrt{\varepsilon})}$$

where f1 represents the low frequency resonance point, C represents a propagation velocity of light in vacuum, S represents the length of the first radiation portion, where the inner edge length of the slot is a part of the length of the first radiation portion, ε is a dielectric constant of the carrier.

10. The antenna device according to claim 1, wherein a relationship between the first high frequency resonance point of the radiation signal and the slot is expressed as follows:

$$f2 = \frac{3C}{4(S\sqrt{\varepsilon})}$$

where f2 represents the first high frequency resonance point, C represents a propagation velocity of light in vacuum, S represents the length of the first radiation portion, where the inner edge length of the slot is a part of the length of the first radiation portion, ε is a dielectric constant of the carrier.

11. The antenna device according to claim 1, wherein a material of the carrier is ceramic.

12. The antenna device according to claim 11, wherein the patterned conductive layer is formed on the ceramic by a silver firing method.

13. The antenna device according to claim 1, wherein a material of the carrier is plastic.

14. The antenna device according to claim 13, wherein the patterned conductive layer is formed on the plastic by using a plastic having a high dielectric constant in combination with a laser direct structure method.

15. The antenna device according to claim 1, wherein the carrier is a rectangular parallelepiped.

16. The antenna device according to claim 15, wherein the rectangular parallelepiped has an upper surface, a lower surface, a front surface, a rear surface, a left surface and a right surface, the radiator and the coupling portion at least respectively continuously extend on the lower surface, the front surface, the upper surface and the rear surface.

17. The antenna device according to claim 8, wherein the grounding face of the substrate is the reference grounding.

18. An antenna device, comprising:

a carrier, the carrier being a rectangular parallelpiped having planar upper and lower surfaces, planar front and rear surfaces, and planar left and right surfaces; and a patterned conductive layer provided on the carrier, the patterned conductive layer having a radiator and a coupling portion, the radiator comprising a first radiation portion, a second radiation portion and a shared part which is shared by the first and second radiation portions, the second radiation portion electrically connecting with the first radiation portion, the shared part being configured to connect to a grounding face provided on a substrate via a grounding line, the coupling portion capacitively coupling an electrical signal to the first radiation portion and the second radiation portion, the first radiation portion and the second radiation portion converting the electrical signal into a radiation signal emitted by the antenna device, the first radiation portion being provided on the upper, lower and front surfaces, the second radiation portion being provided on the upper and rear surfaces, the shared part being provided on the lower surface, the coupling portion being provided on the upper, lower, front and rear surfaces, wherein the first radiation portion has a side edge, the side edge defines a slot, an inner edge length of the slot is a part of a length of the first radiation portion, and wherein the inner edge length of the slot is sized to ensure that a low frequency resonance point and a first high frequency resonance point of the first radiation portion are correct.

19. An antenna equipment, comprising:

a substrate having a grounding face; and an antenna device provided on the substrate, the antenna device comprising a carrier and a patterned conductive layer provided on the carrier, the patterned conductive layer having a radiator and a coupling portion, the radiator comprising a first radiation portion, a second radiation portion and a shared part which is shared by the first and second radiation portions, the second radiation portion electrically connecting with the first radiation portion, the shared part being connected to the grounding face, the coupling portion capacitively coupling an electrical signal to the first radiation portion and the second radiation portion, the first radiation portion and the second radiation portion converting the electrical signal into a radiation signal emitted by the antenna device, wherein the first radiation portion has a side edge, the side edge defines a slot, an inner edge length of the slot is a part of a length of the first radiation portion, and wherein the inner edge length of the slot is sized to ensure that a low frequency resonance point and a first high frequency resonance point of the first radiation portion are correct.

20. The antenna equipment according to claim 19, wherein the substrate has first and second engaging pads, the antenna device provided on the substrate via the first and second engaging pads.

21. The antenna equipment according to claim 20, wherein the carrier has first and second elements, wherein the first element and second elements are fixedly attached to the first and second engaging pads, respectively, by a soldering operation.

22. The antenna equipment according to claim 19, wherein the substrate has a transceiver and a transmitting line, wherein the coupling portion is electrically connected to the transceiver via the transmitting line.

23. The antenna equipment according to claim 19, wherein the substrate has a grounding line, wherein the shared part directly contacts the grounding line and is connected to the grounding face as the reference grounding via the grounding line.

* * * * *